United States Patent [19]

Bingman et al.

[11] 4,313,707

[45] Feb. 2, 1982

[54] SIDE LOADING APPARATUS FOR TRASH COLLECTION SYSTEM

[76] Inventors: John W. Bingman, 1714 E. Gary, Mesa, Ariz. 85203; Julius A. Barker, Jr., 2501 N. 69th St., Scottsdale, Ariz. 85257

[21] Appl. No.: 7,398

[22] Filed: Jan. 29, 1979

Related U.S. Application Data

[63] Continuation-in-part of Ser. No. 762,412, Jan. 25, 1977, abandoned.

[51] Int. Cl.[3] ..... B65B 21/02

[52] U.S. Cl. ..... 414/409; 414/467; 414/544

[58] Field of Search ..... 414/303, 362, 368, 403–410, 414/467, 540–545, 580–581, 595–599, 628–632, 634–656

[56] References Cited

U.S. PATENT DOCUMENTS

| | | | |
|---|---|---|---|
| 470,589 | 3/1892 | Meames | 414/599 |
| 1,441,830 | 1/1923 | Christensen | 414/650 |
| 2,592,324 | 4/1952 | Oliver | 414/409 |
| 2,683,546 | 7/1954 | Sherriff | 414/620 |
| 3,910,434 | 10/1975 | Ebeling et al. | 414/408 |
| 4,005,791 | 2/1977 | Stragier et al. | 414/408 |

FOREIGN PATENT DOCUMENTS

| | | | |
|---|---|---|---|
| 414008 | 2/1924 | Fed. Rep. of Germany | 414/408 |
| 2412096 | 9/1975 | Fed. Rep. of Germany | 414/408 |
| 28443 | of 1909 | United Kingdom | 414/652 |
| 421972 | 12/1934 | United Kingdom | 414/362 |

*Primary Examiner*—Trygve M. Blix
*Assistant Examiner*—R. B. Johnson
*Attorney, Agent, or Firm*—Cahill, Sutton & Thomas

[57] ABSTRACT

A trash collection apparatus is described for mounting on a side loading trash collection vehicle. A frame member is extendably secured to the vehicle for movement away from and toward the truck body of the vehicle. A pair of vertically extending guide rails are secured to the frame; each guide rail incorporates a top section that is pivoted about a horizontal axis. A carriage is mounted for movement along the guide rails and incorporates a pair of gripping arms which are pivoted for movement in a horizontal plane to grasp a trash container and are also pivoted for movement in vertical planes for moving to a stowage position. A hydraulic piston and cylinder are utilized to raise the carriage along the guide rails to position the carriage on the top sections of the rails. Hydraulic actuators are provided for tilting the top sections of the rails when the carriage is positioned on the top sections to tip the carriage, gripping arms, and the trash container over the side of the vehicle.

2 Claims, 12 Drawing Figures

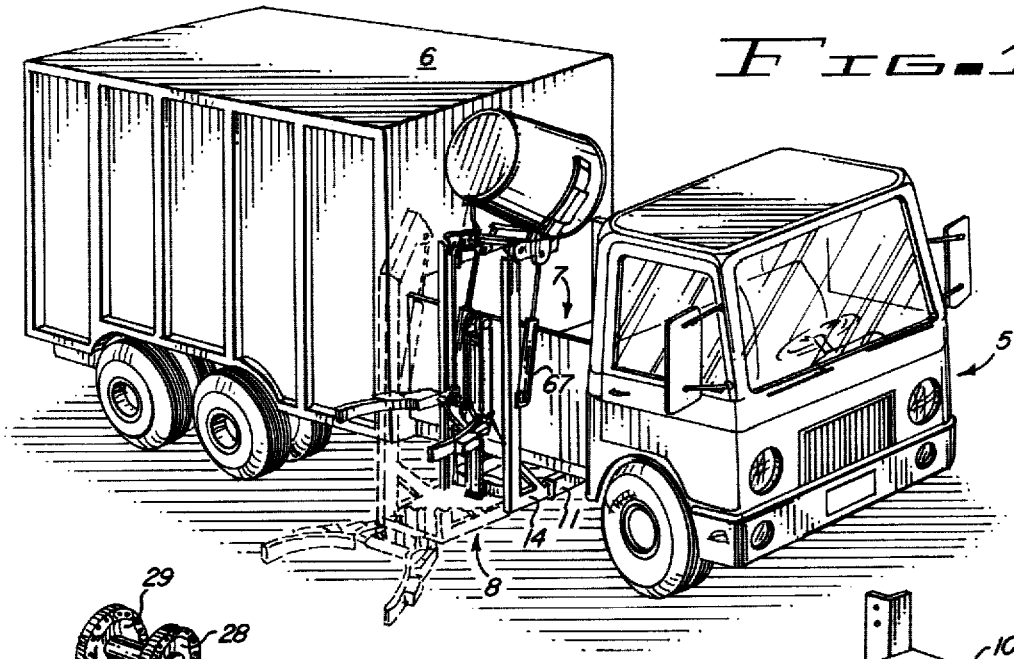
FIG. 1
FIG. 3
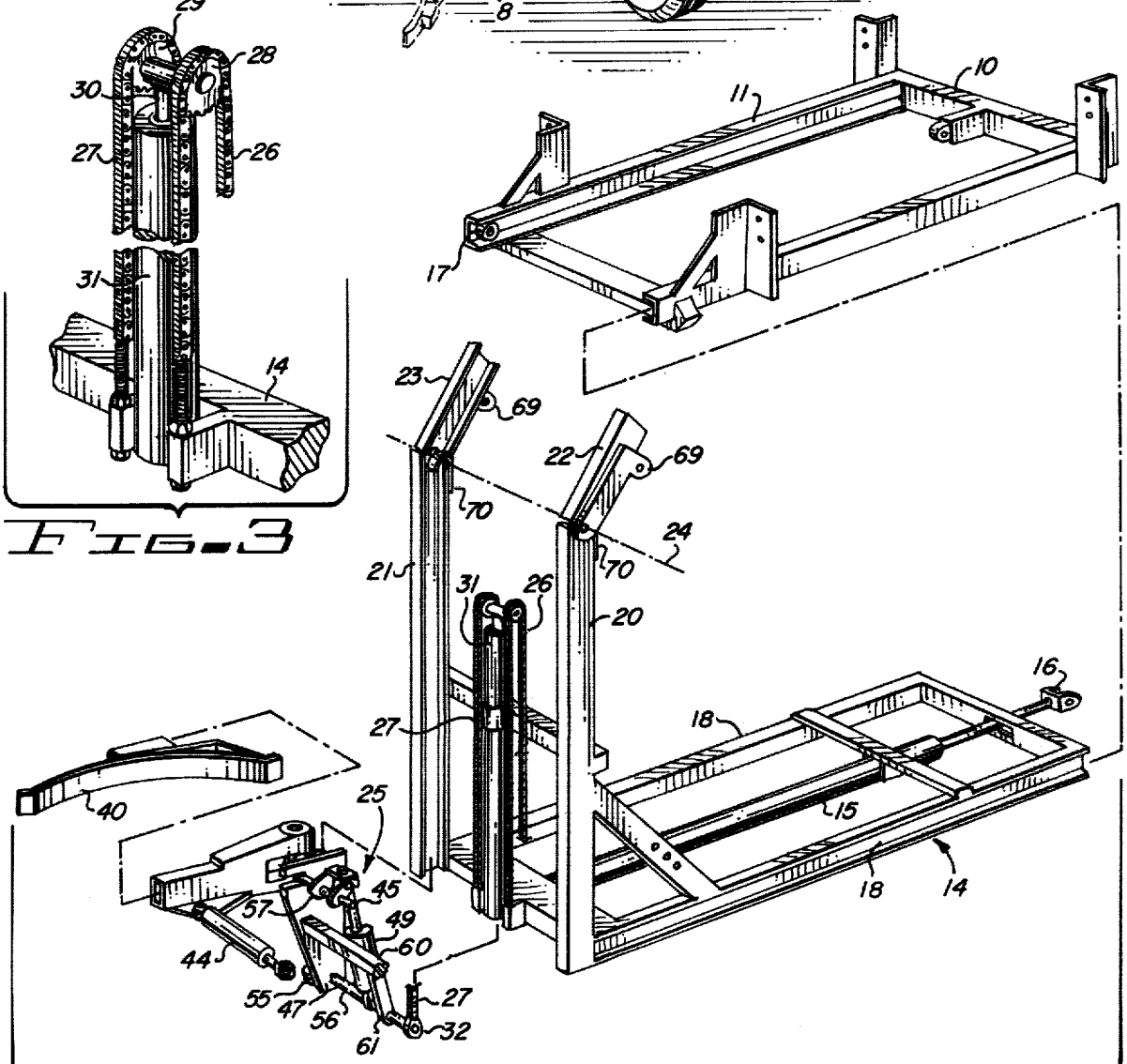
FIG. 2

SIDE LOADING APPARATUS FOR TRASH COLLECTION SYSTEM

CROSS REFERENCE TO RELATED APPLICATIONS

The present application is a continuation-in-part of a patent application entitled "SIDE LOADING APPARATUS FOR TRASH COLLECTION SYSTEM", assigned Ser. No. 762,412 and filed on Jan. 25, 1977, now abandoned and invented by the present inventors.

BACKGROUND OF THE INVENTION

The present invention pertains to trash collection systems, and more specifically to trash collection mechanisms for attachment to trash collection vehicles.

The mechanization of trash collection has been brought about by the pressing need to increase the efficiency of trash collection and reduce the costs incurred in the trash collection process. To provide a mechanism for efficiently emptying trash containers into a collection vehicle, the prior art has resorted to innumerable mechanical arrangements. In the prior art, apparatus has been disclosed wherein trash containers are lifted from the ground and dumped into a collection vehicle or truck; the lifting mechanisms have raised the trash container over the side, front, or back of the vehicle through the expediency of tracks or rails, articulating arms, conveyor systems, and the like. The prior art apparatus incorporates varying degrees of complexity with inherent bulk and widely ranging degrees of reliability. It is well known that in the trash collection industry such mechanisms and the vehicles upon which the mechanism is mounted, are subjected to extremely adverse operating conditions giving rise to frequent breakdowns with resulting decrease in operating efficiency.

It is therefore an object of the present invention to provide an improved trash collection apparatus for mounting on a trash collection vehicle to grasp, lift and dump the contents of a trash container into the vehicle.

It is another object of the present invention to provide an improved trash collection apparatus for mounting on a trash collection vehicle which apparatus is relatively simple and reliable.

It is still another object of the present invention to provide an improved trash collection apparatus for mounting on a side loading trash collection vehicle which apparatus may be used to grasp trash containers and quickly empty the contents thereof into the vehicle and replace the containers in their original position.

It is yet another object of the present invention to provide an improved trash collection mechanism that is more reliable and efficient than prior art side loading trash collection mechanisms.

These and other objects of the present invention will become apparent to those skilled in the art as the description thereof proceeds.

BRIEF SUMMARY OF THE INVENTION

Briefly, in accordance with the embodiment chosen for illustration, a frame is extendably mounted on a trash collection vehicle, the frame is extendable laterally of the vehicle body. A pair of guide rails are secured to the frame and extend upwardly along the vehicle and are therefore also extendable with the frame. The guide rails each incorporate a top section which is secured to its corresponding rail with a hinge to permit the top sections to pivot or tilt about a horizontal axis. A carriage is mounted on rollers which travel along the guide rails to permit the carriage to be elevated from a position close to the bottom of the rails to a dumping position on the top sections of the guide rails. The carriage is urged along the guide rails through a pair of chains which are secured at one end to the frame and at the other end to the carriage. The chains are mounted over a pair of sprockets intermediate thereof which sprockets are attached to a hydraulic piston having a corresponding cylinder secured to the frame. The top sections of the guide rails pivot about the horizontal hinge axis through the use of hydraulic pistons and cylinders which are secured between the top sections and the corresponding lower portions of the guide rails.

BRIEF DESCRIPTION OF THE DRAWINGS

The present invention may more readily be understood by reference to the accompanying drawings in which:

FIG. 1 is a perspective view of a typical side loading trash collection vehicle having the apparatus of the present invention mounted thereon.

FIG. 2 is an exploded view of portions of the apparatus of the present invention showing the extendable frame, guide rails, and gripping mechanism.

FIG. 3 is an enlarged view of a portion of FIG. 2 showing the chains utilized for lifting the carriage.

DETAILED DESCRIPTION OF THE INVENTION

Figure 4:
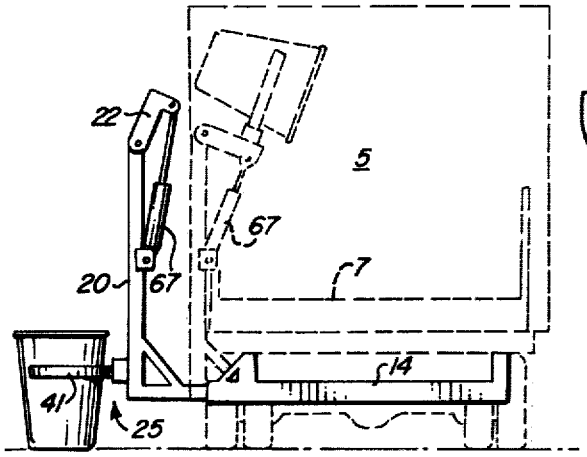
FIG. 4 is a simplified schematic side elevational view, taken along line 4—4 of FIG. 1, of apparatus constructed in accordance with the teachings of the present invention and useful for describing the motion of the various elements of the apparatus during operation.
Figure 7:
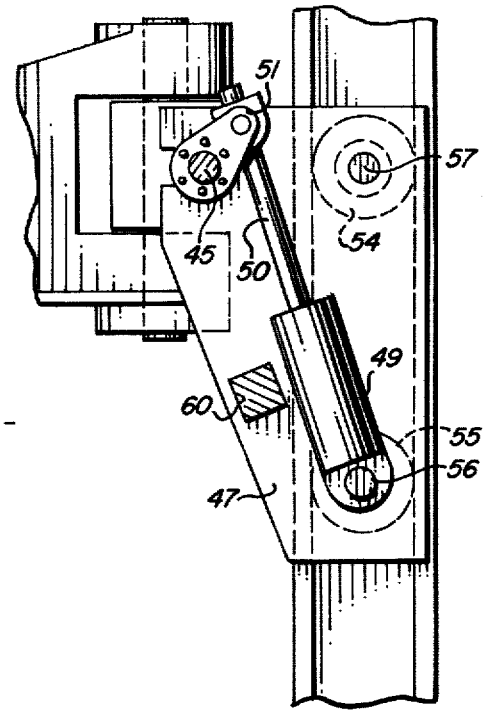
FIG. 7 is a cross-sectional view of a portion of FIG. 6 taken along line 7—7 of FIG. 6.
Figure 5:
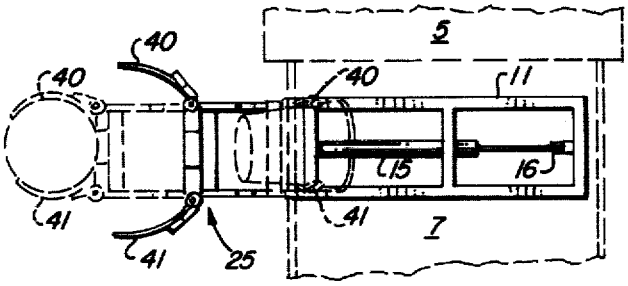
FIG. 5 is a simplified schematic top view of the apparatus of FIG. 4 showing the apparatus grasping a trash container.
Figure 6:
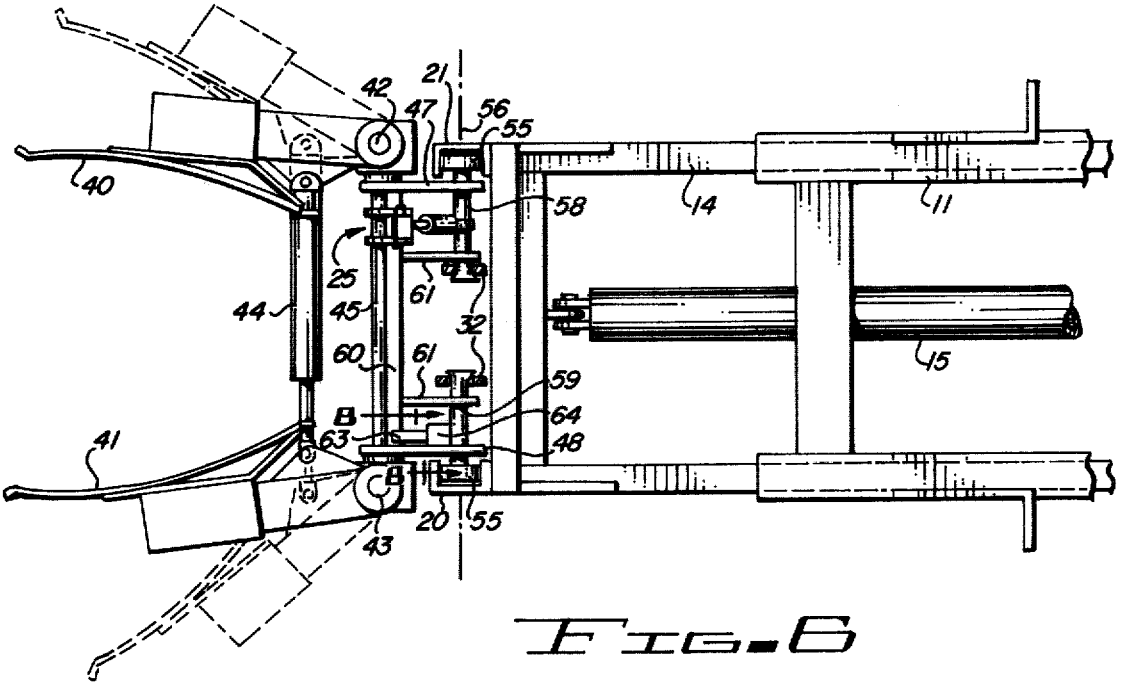
FIG. 6 is a top view of a portion of the apparatus of the present invention partly broken away and partly in section, taken along lines 6—6 of FIG. 1.

Referring now to the drawings, and particularly to FIGS. 1-3, a trash collection vehicle 5 is shown having a truck body 6. The body 6 includes a trash collection bin 7 for receiving trash to ultimately be compacted into the back of the truck for transportation to a trash collection center. The apparatus of the present invention is shown generally at 8 and includes a bracket 10 that is secured to the vehicle frame in a convenient manner. The bracket 10 includes rails 11 that receive a frame 14 that telescopes into the bracket rails 11. The frame 14 is thus laterally extendable of the truck 5 and may be extended through the use of piston/cylinder 15 secured to the frame 14. A clevis 16 is attached to the end of the piston and secured to the bracket 10. Therefore, extension of the piston/cylinder 15 will cause the extension of the frame 14 laterally of the truck while reverse movement of the piston will cause telescoping motion between the frame 14 and the bracket 10 to cause the frame to be withdrawn toward the truck. The lateral extension of frame 14 may be facilitated by providing a plurality of rollers, such as the one shown in FIG. 2 at 17, each of which is secured to the bracket 10 and engages and rides within one of the channel rails 18 of the frame 14. Such rollers reduce the friction between the bracket 10 and the frame 14 and reduce the force necessary to cause the telescoping motion.

A pair of guide rails 20 and 21 are secured to the frame 14 and extend substantially vertically therefrom. Each of the guide rails is formed of a channel that receives and guides a roller as will be described more fully hereinafter. Each of the guide rails 20 and 21 include a top section 22 and 23, respectively. The top sections are secured to their corresponding guide rails for tilting movement about a horizontal hinge axis 24. A carriage, shown generally by the reference numeral 25, is mounted for movement along the guide rails and the top sections. The carriage is moved along the guide rails through a pair of lifting chains 26 and 27 each secured at one end thereof to the frame 14. The chains are mounted over sprockets 28 and 29, respectively, and are secured at their other end to the carriage 25 by chain connectors such as chain connector 32. The sprockets 28 and 29 are rotatably mounted on the end of a lifting piston 30 which is vertically extendable from a lifting cylinder 31. Thus, as the piston is urged upwardly by the force of hydraulic fluid in the piston 31, the sprockets 28 and 29 are also forced upwardly and cause the chains 26 and 27 to lift the carriage 25 to which they are attached. The connector 32 may take any one of a variety of forms; however, the chain connector 32 is pivotally connected to the carriage 25 so that the end of the chain and the connector are free to rotate at the point of connection about a horizontal chain connector axis 34.

Referring now to FIGS. 4–7, the carriage 25 provides support for a pair of gripping arms 40 and 41 which are mounted on the carriage through gripping arm pivot pins 42 and 43, respectively. The gripping arms are shaped to conveniently grasp a trash container prior to the container being lifted and dumped into the trash collection vehicle. The gripping arms 40 and 41 are pivoted about their respective pivot pins through the use of gripping arms cylinder 44, the operation of which causes the gripping arms to move toward and away from each other in a horizontal plane. When the apparatus of the present invention is not being used to actively grasp and dump a trash container, and the vehicle upon which the apparatus is mounted is traveling on a road, it is necessary for the apparatus to be "stowed" to insure that no parts of the apparatus extend outwardly from the truck to form a safety hazard. The gripping arms 40 and 41 are therefore pivoted about a horizontal axis in addition to being pivoted about their respective pivot pins for grasping a container. Both gripping arms are simultaneously pivoted about a horizontal axis to a substantially vertical plane for stowing during transportation of the apparatus. The motion about a horizontal axis is achieved by the mounting of the gripping arms 40 and 41 as well as the gripping arm pivot pins 42 and 43 on gripping arm stowing shaft 45 which extends between the carriage side plates 47 and 48. A stowing cylinder 49 is connected through the stowing piston 50 to a stowing crank 51 which in turn is connected to the gripping arm stowing shaft 45. Retraction of the piston 50 into the cylinder 49 thus results in the rotation of the stowing shaft 45 to cause both gripping arms 40 and 41 to pivot about the horizontal axis of the shaft 45 into a vertical plane to insure that no apparatus extends from the truck to form a safety hazard during transportation of the truck on public roads.

Figure 8:
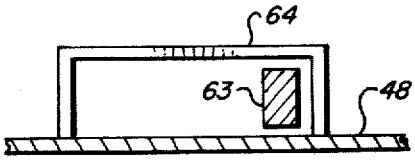
FIG. 8 is a cross-sectional view of a portion of FIG. 6 taken along line 8—8 of FIG. 6.
Figure 10:
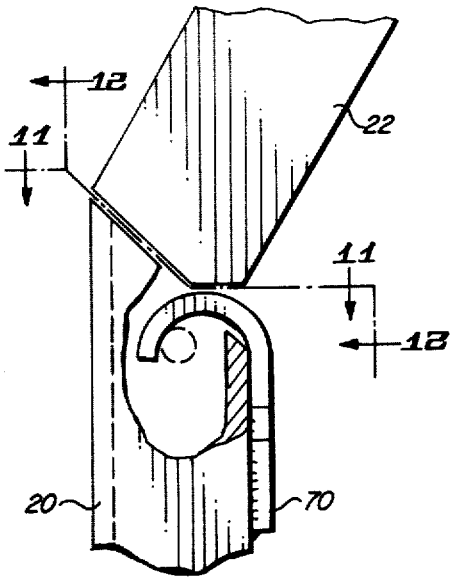
FIG. 10 is an enlarged view, partly broken away, of a portion of FIG. 9.
Figure 9:
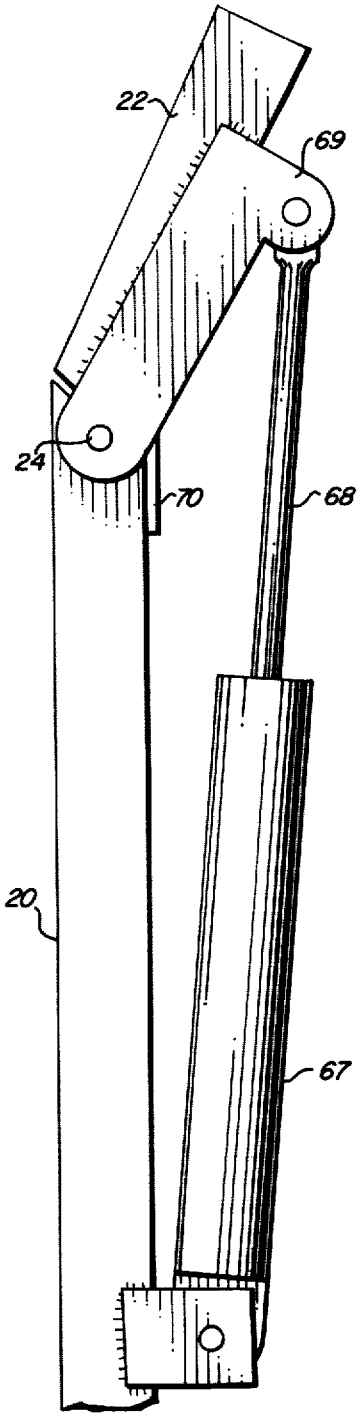
FIG. 9 is a side elevational view of the tilting mechanism incorporated in the apparatus of the present invention.
Figure 11:
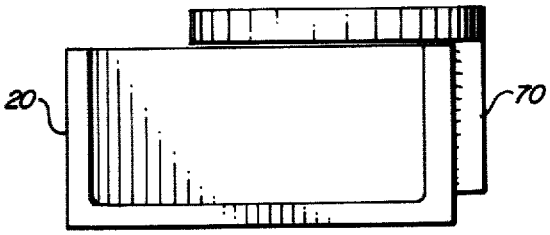
FIG. 11 is a top view of a portion of FIG. 10 taken along line 11—11 of FIG. 10.
Figure 12:
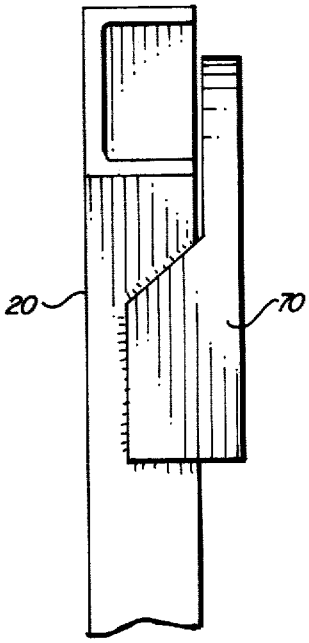
FIG. 12 is a side view of a portion of FIG. 10 taken along line 12—12 of FIG. 10.

The carriage 25 is movable along the guide rails 20 and 21 through the expediency of two pairs of guide rollers 54 and 55. The lower pair of guide rollers 55 are mounted for rotation about a horizontal axis of rotation 56; the importance of the axis 56 will become apparent as the description proceeds. Mounting bars 58 and 59 extend inwardly from the side plates 47 and 48, respectively, and terminate in slightly flanged ends near which the chain connectors 32 are mounted. The mounting bars 58 and 59 are strengthened through the use of braces 61 attached to the mounting bars; the braces 61 are in turn welded to the support bar 60 which extends between the side plates 47 and 48. The side plate 48 also supports a stow position stop bracket 64 (also shown in FIG. 8) that limits the movement of a stow position stop arm 63 secured to the stowing shaft 45. The stop arm 63 thus limits the movement of the gripping arms 40 and 41 when they are lowered to their operating position such that the arms are in a horizontal plane; similarly, when the arms are pivoted upwardly to their stowed position, the stop arm 63 insures that the arms 40 and 41 are stopped in a vertical plane.

Referring now specifically to FIGS. 9–12, the guide rail 20 is shown in greater detail. The top section 22 is secured to the guide rail 20 for tilting movement about horizontal hinge axis 24. The pivoting or hinging movement about the axis 24 is achieved through the use of a tilting cylinder 67 which extends and retracts a piston 68 connected to a tilting bracket 69. A stop bracket 70 is secured to the guide rail 20 and extends over the open upper end of the guide rail in a hooked fashion for contacting and positioning the carriage.

In operation, the truck 5 is positioned by the driver laterally opposite the trash container to be dumped. Hydraulic fluid under pressure is admitted to the cylinder 15 to cause the extension of the frame 14 from the bracket 10. The gripping arms 40 and 41 are then moved in a horizontal plane to grasp the container through operation of the cylinder 44. When the container has been grasped, the lifting cylinder 31 is actuated to extend the lifting piston 30. As the piston 30 extends upwardly, the sprockets 28 and 29, in contact with their respective chains 26 and 27, thus lift the carriage 25 to which the chains are connected. As the carriage is lifted, the pairs of guide rollers 54 and 55 follow the guide rails 20 and 21. As the upper guide rollers 54 reach the top sections 22 and 23 of the guide rails, the rollers pass the junction between the top sections and the respective vertical guide rails and continue to travel upwardly. The upper guide roller pins 57 are secured to the side plates 47 and 48 and do not protrude inwardly from the side plates. The stop bracket 70 (only one bracket has been shown for simplicity, in the embodiment chosen for illustration, however, a stop bracket is utilized on each of the guide rails 20 and 21) is positioned so that it extends into the path of the carriage 25 inwardly of the side plates 47 and 48 and in interfering position with the mounting bars 58 and 59. Since the upper guide rollers are mounted on pins 57 which do not extend inwardly of the side plates 47 and 48, the guide rollers are free to continue upward movement from the respective guide rails to the top sections.

As the upward motion of the carriage continues, the upper guide rollers 54 continue to follow the top sections 22 and 23 while the lower guide rollers 55 continue to follow the guide rails 20 and 21. As the bottom portion of the carriage 25 approaches the intersection of the guide rails with their respective top sections, the mounting bars 58 and 59 come into contact with the hooked portions of the stop brackets 70. The upward motion of the carriage is thus arrested with the mounting bars 58 and 59 in contact with the curved or hooked portion of the stop brackets 70; in this position, it may be noted that the upper guide rollers 54 are in contact with the top sections 22 and 23 while the lower guide rollers 55 remain in contact with the guide rails 20 and 21 below the intersection of the guide rails with their respective top sections. The stop brackets 70 are positioned to interfere with the upward motion of the mounting bars 58 and 59 so that the horizontal axis of rotation 56 of the lower guide rollers 55 coincides with the horizontal hinge axis 24. Therefore, any subsequent tilting motion of the upper sections 22 and 23 about the hinge axis 24 will result in the corresponding tilting of the carriage 25 about its guide roller axis of rotation 57 since the axis of rotation 56 and the hinge axis 24 are coincident. The tilting motion is accomplished through the actuation of tilting cylinder and piston 67 and 68 which causes the top sections 22 and 23 to tilt about the common horizontal hinge axis. Since the chain connectors 32 are secured to the mounting bars 58 and 59 the relative pivotal motion between the ends of the chain and the carriage is not only about the chain connector axis 34 but also about the guide roller horizontal axis of rotation 56. Therefore, when the carriage has been moved to its uppermost or dumping position, the horizontal hinge axis 24, the chain connector axis 34, and the guide roller axis of rotation 56 are all horizontal and are coincident. In the dumping position, the pair of lower guide rollers 55 are therefore positioned on the guide rails 20 and 21 while the upper guide rollers 54 are positioned on the top sections 22 and 23. The tilting cylinder 67 is then actuated to tilt the top sections downwardly to cause the contents of the trash container to be dumped into the bin 7 of the trash collection vehicle 5. While the angle of tilt of the top sections 22 and 23 during the dumping operation is not critical, it has been found that an angle of approximately 120° from vertical as viewed from the front of the truck is satisfactory. When the trash container has been emptied, the tilting cylinder 67 is actuated to return the top sections 22 and 23 to their original, non-dumping positions. It may be noted that the top sections 22 and 23 extend at a slight angle with respect to their corresponding guide rails (see FIGS. 2 and 9) when in a non-dumping position. The angle is not critical and indeed need not exist. That is, the top sections may extend vertically as continuations of the guide rails without affecting the fundamental operation of the apparatus; however, it has been found that an angle of approximately 18° renders the tilting or dumping action of the top sections easier to accomplish with a minimum number of elements.

The carriage 25 is then lowered by reversing the action of the lifting piston 30 until the carriage is lowered to the point that the trash container contacts the ground. The gripping arm cylinder 44 is then reversed and the gripping arms 40 and 41 swing in a horizontal plane away from the trash container and release the container. The cylinder 15 is then activated to retract the frame 14 into telescoping engagement with the bracket 10 and to withdraw the frame together with the guide rails 20 and 21 toward the truck body. The gripping arms 40 and 41 may then be placed in their stowing position by activating the stowing cylinder 49 to rotate the gripping arms about the stowing shaft 45 until the stop arm 63 contacts the stop bracket 64 to thus position the gripping arms in a substantially vertical plane. With the apparatus thus positioned, the vehicle may now travel on public roads with no part of the apparatus extending laterally beyond the body of the vehicle and without presenting a safety hazard.

The apparatus of the present invention may readily be removed from the trash collection vehicle if the vehicle is to be replaced. The various hydraulic cylinders may be operated from a conventional hydraulic fluid source with the controls such as valves and the like conveniently located within the cab of the vehicle.

We claim:

1. In a trash collection system for loading trash into the truck body of a side loading trash collection vehicle, the improvements comprising:

a. a frame member extendably secured to said truck body for horizontal movement away from and toward said truck body;

b. a pair of guide rails, parallel to each other, mounted on said frame member and extending substantially vertically upwardly therefrom along side said truck body, said guide rails movable with said frame member toward and away from said truck body; each of said guide rails having a top section hingedly secured to the remainder of said rail for tilting movement about a horizontal hinge axis;

c. a carriage having a lower pair of rollers mounted for rotation about a common horizontal axis of rotation and an upper pair of rollers, each of said lower pair of rollers engaging a different one of said pair of guide rails and each of said upper pair of rollers engaging a different one of said pair of guide rails for guiding said carriage along said rails from a rest position near the bottom of said rails to a dump position near the top of said rails;

d. a pair of gripping arms mounted on said carriage, each of said arms pivotal about a vertical axis for movement toward and away from each other for gripping a trash container, said arms also pivotal about a horizontal axis for movement into a stowing position in a substantially vertical plane;

e. lifting means for raising said carriage along said rails, said lifting means including a piston and cylinder secured at one end thereof to said frame member and having a sprocket secured to the other end, a chain secured at one end thereof to said frame member, said chain passing over said sprocket and secured at its other end to said carriage about a horizontal pivot axis to permit pivotal movement of said carriage with respect to said chain about said horizontal pivot axis, said horizontal pivot axis being coincident with said common horizontal axis of rotation;

f. stop means secured to at least one of said guide rails below the top section thereof, and positioned to contact said carriage to stop said carriage with said common horizontal axis of rotation coincident with said horizontal hinge axis, whereby said horizontal hinge axis, said common horizontal axis of rotation, and said horizontal pivot axis are all coincident with each other when said carriage is in said dump position; and g. tilting means connected to the top section of said rails for tilting said top section about said horizontal hinge axis when said carriage is positioned on said top section and said common horizontal axis of rotation of said lower pair of rollers coincides with said horizontal hinge axis.

2. The combination set forth in claim 1 wherein said tilting means comprises a piston and cylinder secured at one end to a guide rail and secured at the other end to the top section of said guide rail.

* * * * *